United States Patent [19]

Collin et al.

[11] Patent Number: 4,467,299

[45] Date of Patent: Aug. 21, 1984

[54] ADAPTER ASSEMBLY FOR CIRCUIT BREAKER UNDERVOLTAGE RELEASE ACCESSORY

[75] Inventors: Edwin J. Collin, Southington; Charles L. Jencks, Avon, both of Conn.

[73] Assignee: General Electric Company, New York, N.Y.

[21] Appl. No.: 446,808

[22] Filed: Dec. 3, 1982

[51] Int. Cl.[3] ..... H01H 83/12

[52] U.S. Cl. ..... 335/20; 335/164

[58] Field of Search ..... 335/20, 164; 200/153 SC

[56] References Cited

U.S. PATENT DOCUMENTS

| | | | |
|---|---|---|---|
| 4,061,993 | 12/1977 | Hennemann | 335/20 |
| 4,097,831 | 6/1978 | Jencks et al. | 335/20 |
| 4,128,750 | 12/1978 | Castonguay | 335/20 |

*Primary Examiner*—J. D. Miller
*Assistant Examiner*—George Andrews
*Attorney, Agent, or Firm*—R. A. Menelly; W. C. Bernkopf; Fred Jacob

[57] ABSTRACT

An adapter assembly is provided for use with circuit breakers having automatic charge and employing undervoltage release accessory. The adapter is inserted between the undervoltage release tripping mechanism and the circuit breaker operating mechanism to prevent the circuit breaker from tripping from a charged position when the circuit breaker contacts are open. The adapter assembly interferes with the undervoltage tripping lever when the circuit breaker contacts are open to prevent the undervoltage release tripping mechanism from tripping the breaker under conditions of undervoltage or power outage, thus providing a true stored energy device regardless of undervoltage conditions.

3 Claims, 4 Drawing Figures

25
18
42
26
26A
55
43
30
27
29
9
28
53
50
47
52
31B
51B
31
31C
51A
31A
44B
44A
32
46
45
34
48
21
54
33

ADAPTER ASSEMBLY FOR CIRCUIT BREAKER UNDERVOLTAGE RELEASE ACCESSORY

BACKGROUND OF THE INVENTION

U.S. Pat. No. 4,128,750 to Castonguay et al. discloses a circuit breaker operating mechanism having powerful mechanism springs to assist in closing the breaker contacts and for rapdily opening the contacts under a stored spring force upon the occurrence of a fault condition. When circuit breakers are employed in a stand-by condition, the breaker is charged by either a manual handle or motor driven mechanism to provide a spring force in excess of 100 pounds for closing the breaker contacts while retaining sufficient force to trip the breaker. When the charged stand-by condition is reached, a command signal can then be applied to the breaker operating mechanism instructing the breaker contacts to close. If the breaker is equipped with the undervoltage release accessory apparatus described in U.S. Pat. No. 4,097,831 to Jencks et al., an undervoltage condition, such as could appear with temporary power outages, will cause the undervoltage release tripping mechanism to trip the breaker not only from a closed position, but also from a charged stand-by condition while the contacts are already open. Since some of the stored spring force is depleted when closing the breaker contacts, the breakers are designed to withstand a force somewhat less than the fully charged spring force. The condition of tripping a breaker from an open contact position through a fully charged mechanism spring is termed "crashing" the breaker mechanism. Repeated "crashing" operations will result in reduced mechanism life.

The purpose of this invention is to provide an adapter assembly for use with charged-type circuit breakers which employ an undervoltage release accessory for preventing undervoltage tripping when the circuit breaker is in an open contact "charged" position.

SUMMARY OF THE INVENTION

An adapter assembly is provided between an undervoltage release accessory and a circuit breaker operating mechanism for interfering with the undervoltage tripping mechanism when the charged circuit breaker operating mechanism is in an open contact position. The crossbar assembly of the charged breaker contacts a portion of the adapter and forces the adapter, in turn, to contact and interfere with the undervoltage tripping lever. Early in the breaker closing operation, the crossbar assembly releases the adapter assembly so that the undervoltage release tripping lever can function without interference.

DESCRIPTION OF THE PREFERRED EMBODIMENT

Figure 1:
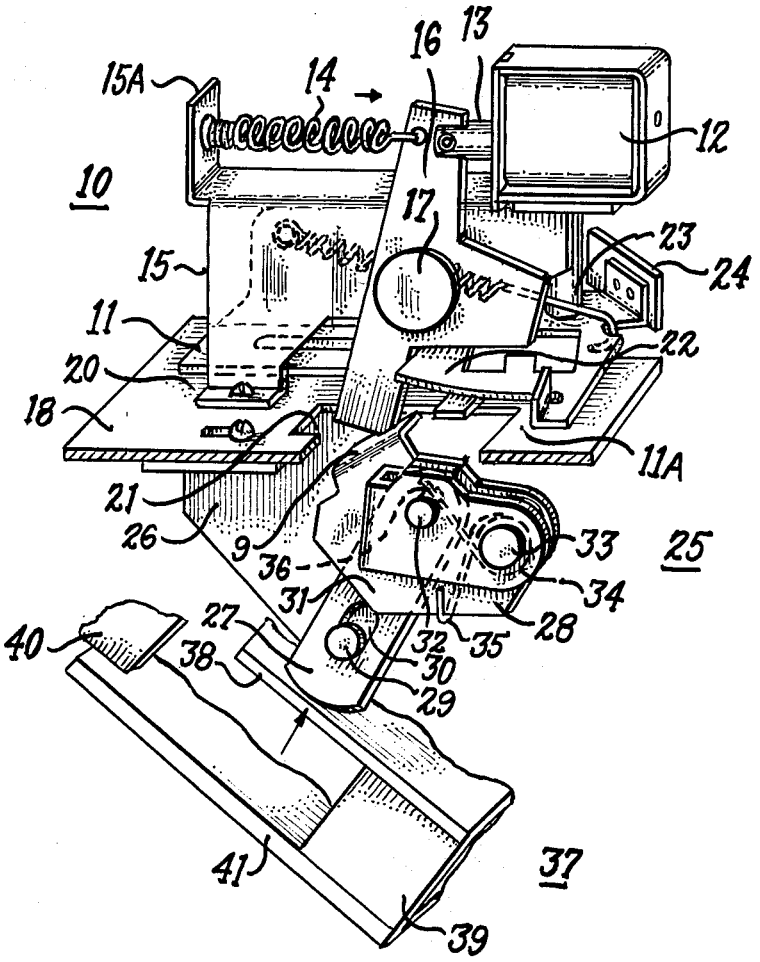
FIG. 1 is a top perspective view of the undervoltage release adapter assembly according to the invention positioned between an undervoltage release mechanism and a circuit breaker crossbar assembly.

The undervoltage release adapter assembly of the invention is shown in FIG. 1 between an undervoltage release mechanism 10 and a crossbar assembly 37. The aformentioned Patents relating to an undervoltage mechanism and a circuit breaker operating mechanism are incorporated herein for purposes of reference and a more detailed description of both the operating mechanism and the undervoltage release apparatus can be obtained by referring to both of these Patents. The undervoltage release 10 generally consists of a mounting platform 15 which supports a solenoid 12 having a plunger 13 connected to an extension spring 14. An operating lever 16, attached to the platform by means of a pivot 17, is held in a bi-stable position against the tension of spring 14 by means of solenoid plunger 13. The opposite end of spring 14 is fixedly secured to a support 15A. The operating lever 16 pivotally contacts the undervoltage release trip latch 22 which is mounted on table 18 by means of a pivot 23. The accessory trip latch 22 has a trip plate 24 for contacting the circuit breaker trip mechanism (not shown). The mounting platform 15 is fixedly attached to table 18 by means of a tab 20 on the mounting platform 15 which accomodates a bolt for connection with table 18. The circuit breaker mechanism (not shown), upon tripping, causes the undervoltage release operating lever 16 to move in the indicated direction by means of the tab 11A of the slide 11 causing spring 14 to extend. The charging action of the breaker moves slide 11 away from lever 16 thus arming the undervoltage tripping mechanism. If, upon charging the breaker, sufficient voltage is applied to solenoid 12, plunger 13 is held within the solenoid and retains the operating lever 16 against the force applied by extended spring 14. In the event that insufficient voltage occurs, solenoid 12 releases plunger 13 and spring 14 then forces the operating lever 16 to rotate about pivot 17 bringing the operating lever into contact with the undervoltage release trip latch 22. As described eariler, it is detrimental to the life of the circuit breaker operating mechanism to trip the breaker when the contacts are in an open charged position. This could occur if an undervoltage condition should occur when the breaker contact operating spring is fully charged and the breaker contacts are in an open charged position. To prevent this from occurring, and undervoltage release adapter assembly 25 is attached to the bottom of table 18. Table 18 includes a table slot 21 through which the undervoltage release operating lever 16 extends. In the absence of undervoltage release adapter assembly 25, the undervoltage release operating lever can move freely within table slot 21 to contact the undervoltage release trip latch 22. To prevent the undervoltage release operating lever 16 from operating when the circuit breaker contacts are open, an adapter operating lever 28 is situated under table 18 in such a manner that a flat contact portion 9 extends up within table slot 21 and interferes with the motion of operating lever 16. The adapter operating lever 28 is attached to a bell crank 31 by means of pin 32 and the bell crank 31 is pivotably supported on pivot bar 33. Also attached to bell crank 31, by means of pin 32, is an operating slide 27 which contains a slot 30. Pin 29, fixedly secured to support 26, allows slide 27 to move along pin 29 which is confined within slot 30. An overtravel torsion spring 34 placed around pivot bar 33 and attached to pin 32, by means of end 36, and to lever 28, by means of end 35, biases lever 28 and bell crank 31 together as a unit. A portion of the circuit breaker crossbar assembly 37, employed in the breaker tripping and closing function, is shown in relation to the undervoltage release adapter assembly 25. A paddle 38 is attached to the contact carrier 41 through an insulated crossbar 39. In the open contact position, paddle 38 forces slide 27 in the indicated direction so that slot 30 approaches pin 29 as crossbar assembly bottoms on fixed stop 40. Bell crank 31 and attached adapter operating lever 28 also move in the indicated direction forcing the flat end 9 of adapter operating lever 28 up through the table slot 21 and into contact with the undervoltage release operating lever 16 as shown. The undervoltage release solenoid plunger 13 is shown in retracted position against the tension of spring 14. This is indicative of a charged solenoid wherein the applied voltage is sufficient to maintain the plunger 13 within the solenoid 12. Should an undervoltage condition occur, such that plunger 13 becomes extended under the force of tension spring 14, the undervoltage release operating lever 16 would interfere with the flat end 9 of the adapter operating lever 28 to prevent it from pivoting about pivot 17 to cause the undervoltage release trip bar 22 to move forward. As long as the flat portion 9 of the undervoltage release adapter lever 28 remains in interfering contact with the undervoltage release operating lever 16, the breaker will remain untripped.

Figure 2:
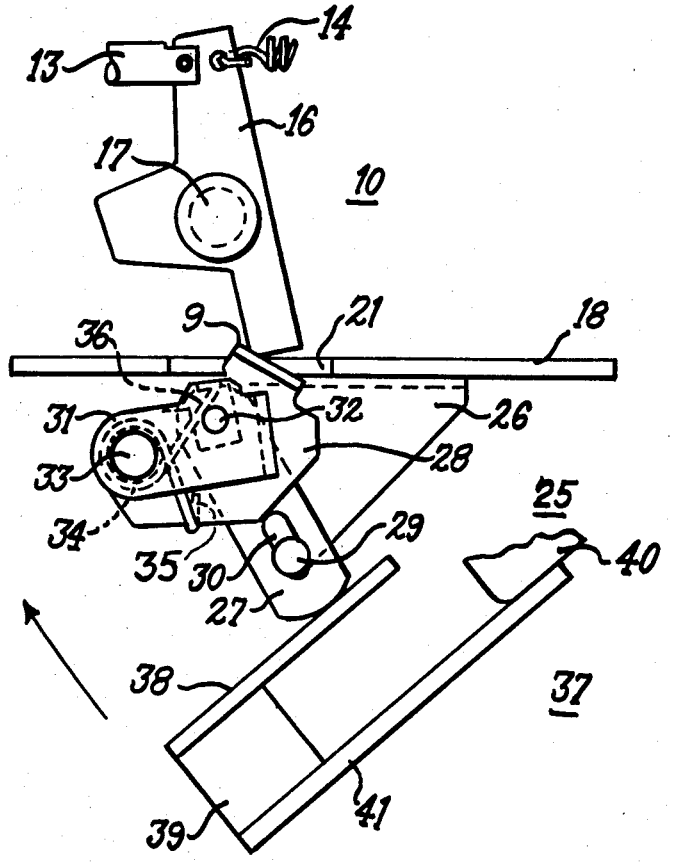
FIG. 2 is an opposite side view of the assembly depicted in FIG. 1 in greater detail.

FIG. 2 shows the undervoltage release adapter 25 in interfering contact with the undervoltage release operating lever 16 in greater detail. For purposes of clarity, only the undervoltage release operating lever 16 and pivot 17 are shown. The connection between extension spring 14 and solenoid plunger 13 are in the same relationship as shown in FIG. 1. The flat end 9 of the adapter operating lever 28 is shown extended through table slot 21 and in contact with the undervoltage release operating lever 16. The operating lever slot 30 is approaching pin 29 and slide 27 is fully extended in the indicated direction. The crossbar assembly 37 is shown in the open contact position with the contact carrier 41 in contact with the fixed stop 40 and with paddle 38 against the adapter slide 27. The bell crank 31 is held in the up position shown by slide 27 and pin 32 against the force of torsion spring 34, which maintains the adapter operating lever 28, against undervoltage release lever 16 by means of end 35, and against pin 32 by means of end 36, as described eariler. Torsion spring 34 is of sufficient strength to maintain operating lever 16 and surface 9 of adapter lever 28 in an interference condition.

Figure 3:
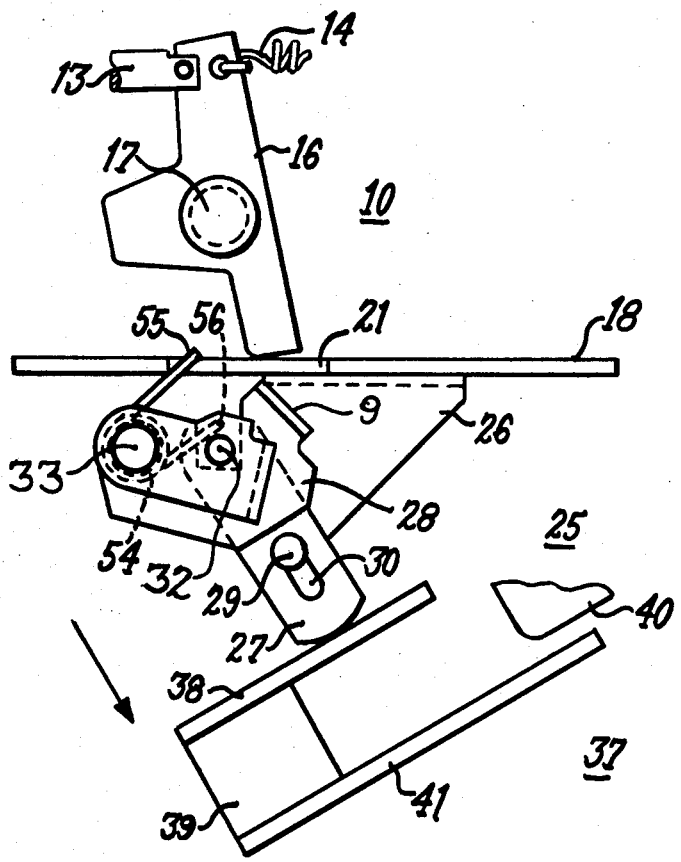
FIG. 3 is an opposoite side view of the assembly according to the invention in a disengaged position.

FIG. 3 shows the undervoltage release adapter assembly 25 subjacent the undervoltage release mechanism 10 when the crossbar assembly 37 is approaching a closed contact position. Here the operating mechanism paddle 38 is out of contact with slide 27 and the opposite end of slot 30 now contacts pin 29 under the force of the return torsion spring 54 which is placed around pivot bar 33 and attached to pin 32, by means of end 56, and to slot 21 of table 18, by means of end 55. Torsion spring 54 biases adapter assembly 25 clockwise about pin 33. The flat end 9 of the adapter operating lever 28 is now away from the undervoltage release operating lever 16 so it can freely move into contact with the undervoltage release trip latch, if an undervoltage condition should occur, to trip the breaker. Should the circuit breaker become tripped, the crossbar assembly will assume the position indicated eariler in FIG. 1 and the adapter operating lever 28 will be forced back to the position also shown in FIG. 1.

Figure 4:
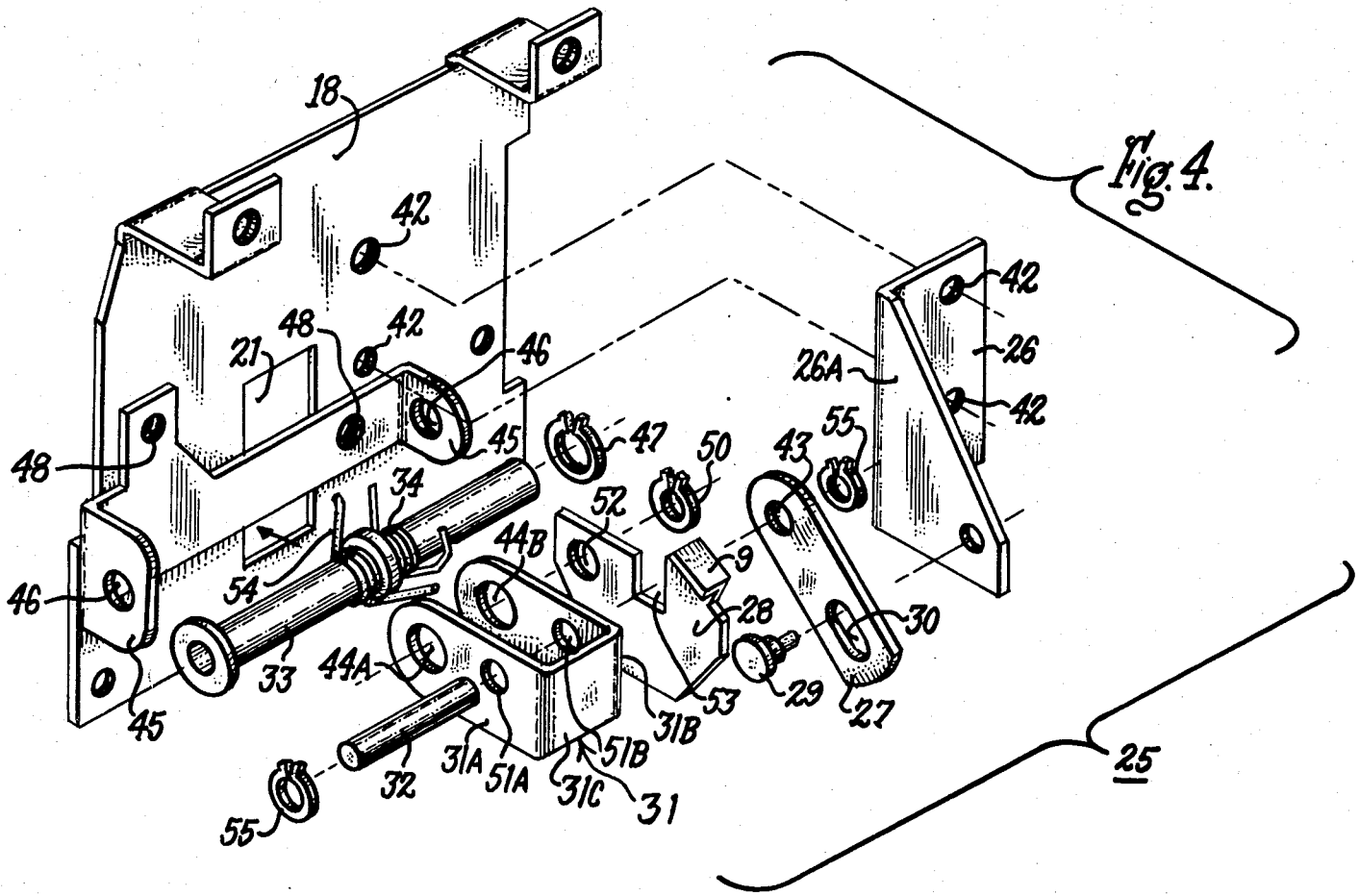
FIG. 4 is a bottom perspective view in isometric projection of the undervoltage release adapter assembly according to the invention.

The assembly arrangement between the components of the undervoltage release adapter assembly 25 shown in FIGS. 1–3 is now depicted in FIG. 4. Pivot bar support 45 is attached to table 18 by means of mounting holes 48 subjacent table slot 21. Pin 33 is inserted within pin openings 46 provided at both ends of the pin support 45 and is retained by means of clips 47. Pin 33 is inserted through one pin opening 46 of pivot bar support 45 and then through pin opening 44A, within the sidewall 31A, of bell crank 31. The torsion springs 34 and 54 are arranged around the pin 33 before insertion through hole 44B is sidewall 31B of bell crank 31. Pivot bar 33 is then inserted through an opening 52 in the adapter operating lever 28 and a retainer clip 50 is positioned over the pivot bar 33 to hold the adapter operating lever up against bell crank sidewall 31B. Once the bell crank 31 and adapter operating lever 28 and springs 34 and 54 are arranged on pivot bar 33, then the pivot bar can now be inserted through the remaining opening 46 of the pivot bar support 45. Pin 32 pivotally maintains the undervoltage adapter slide 27 to bell crank 31 in the following manner. The pin 32 is inserted through pin openings 51A, 51B in the bell crank sidewalls 31A, 31B, through pin opening 53 in the adapter operating lever 28 and through pin opening 43 in slide 27 before attaching pin clips 55 at both ends. Before attaching support 26 to table 18 by means of mounting holes 42, pin 29 is inserted through slot 30 of slide 27 and riveted to support sidewall 26A of support 26.

An added feature of the adapter assembly of the invention is the ability to allow the undervoltage release accessory to operate on the occurrence of an undervoltage condition before the breaker contacts reach a closed position and thereby prevent a momentary closure of the contacts. This momentary closure would otherwise allow some temporary current transfer to occur through the contacts to the protected circuit with deleterious effects.

Having thus described our invention, what we claim as new and desire to secure by Letters Patent is:

1. An adapter for a circuit breaker undervoltage release accessory of the type consisting of a tripping mechanism for causing an operating mechanism within the breaker to open the breaker contacts upon the occurrence of an undervoltage condition comprising:

an operating lever pivotally attached to a support proximate said undervoltage release accessory for interfering with the tripping mechanism of said undervoltage release accessory to prevent said tripping mechanism from operating when the breaker contacts are already open; and a slide means attached to said support by means of a pin on said support captured within a slot in said slide at one end and attached to said operating lever at an opposite end, said slide means being operatively arranged between said operating lever and said breaker operating mechanism for contacting a portion of the circuit breaker operating mechanism to operatively move said operating lever in and out of contact with said undervoltage release tripping mechanism.

2. An adapter for a circuit breaker undervoltage release accessory of the type consisting of a tripping mechanism for causing an operating mechanism within the breaker to open the breaker contacts upon the occurrence of an undervoltage condition comprising;

an operating lever pivotally attached at one end to a support proximate said undervoltage release accessory to prevent said tripping mechanism from operating when the breaker contacts are already open, and slide means slidably attached to said support at one end and attached to said operating lever by means of a pivot pin at an opposite end, said slide means being operatively arranged between said operating lever and said breaker operating mechanism to move said operating lever in and out of contact with said undervoltage release accessory tripping mechanism.

3. An adaptor for a circuit breaker undervoltage release accessory of the type consisting of a tripping mechanism for causing an operating mechanism within the breaker to open the breaker contacts upon the occurrence of an undervoltage condition comprising:

an operating lever pivotally attached by means of a bell crank to a support proximate said undervoltage release accessory for interfering with the tripping mechanism of said undervoltage release accessory to prevent said tripping mechanism from operating when the breaker contacts are already open; and slide means operatively arranged between said operating lever and said breaker operating mechanism for contacting a portion of the circuit breaker operating mechanism to operatively move said operating lever in and out of contact with said undervoltage release tripping mechanism.

* * * * *